United States Patent [19]

Davis

[11] Patent Number: 4,998,305

[45] Date of Patent: Mar. 12, 1991

[54] SHOWER APPARATUS

[76] Inventor: John W. Davis, Rt. 2, Box F, Rayville, La. 71269

[21] Appl. No.: 314,790

[22] Filed: Feb. 24, 1989

[51] Int. Cl.[5] ..... A47K 3/12

[52] U.S. Cl. ..... 4/604; 4/605; 4/560

[58] Field of Search ..... 4/604, 597, 578, 563, 4/562, 561, 560, 547, 546, 540, 559, 605, 579

[56] References Cited

U.S. PATENT DOCUMENTS

| | | | |
|---|---|---|---|
| 2,052,628 | 9/1936 | Higgins | 4/578 |
| 2,664,142 | 12/1953 | Scheuerman et al. | 4/578 |
| 3,022,518 | 2/1962 | Hayden | 4/578 |
| 3,413,662 | 12/1968 | Stayton | 4/562 |
| 3,815,163 | 6/1974 | Sullivan | 4/562 |
| 3,879,770 | 4/1975 | Grant | 4/578 |
| 3,918,108 | 11/1975 | Feyerherm | 4/578 |
| 3,994,030 | 11/1976 | Cassell et al. | 4/578 |
| 4,628,550 | 12/1986 | Walton | 4/562 |

FOREIGN PATENT DOCUMENTS

| | | | |
|---|---|---|---|
| 2614527 | 11/1988 | France | 4/559 |
| 8302721 | 8/1983 | PCT Int'l Appl. | 4/563 |

*Primary Examiner*—Henry J. Recla
*Assistant Examiner*—Glenn T. Barrett
*Attorney, Agent, or Firm*—John M. Harrison

[57] ABSTRACT

A shower apparatus designed specifically to accommodate wheelchair-bound persons and invalids, which shower apparatus is characterized by a rotatable seat support having one end attached to a telescoping column and the opposite end carrying an upright seat pedestal which receives a rotatable seat for supporting the occupant. The telescoping column is located outside of a shower enclosure and is designed to facilitate selective pivoting of the seat pedestal and seat into and from the shower enclosure. A latching device may be provided outside of the shower enclosure for locating and securing a wheelchair adjacent to the shower enclosure and the wheelchair may be specially designed to receive the rotatable seat and facilitate transfer of a person from the wheelchair to the seat, into the shower, and back to the wheelchair.

5 Claims, 2 Drawing Sheets

SHOWER APPARATUS

BACKGROUND OF THE INVENTION

Field of the Invention

This invention relates to shower apparatus for wheelchair-bound persons and more particularly, to a shower apparatus which is designed to receive, support and transfer non-ambulatory invalids and wheelchair-bound persons from a wheelchair into shower enclosure and back to the wheelchair.

One of the problems which is realized in bathing wheelchair-bound persons, invalids and non-ambulatory persons in a shower enclosure is that of transporting the person to the shower enclosure, supporting the occupant during the showering operation and subsequently transporting the person back from the shower enclosure to the wheelchair. Consequently, many wheelchair-bound patients and invalids must use a tub instead of a shower enclosure, although showering is much more efficient and consumes less water and time than tub bathing.

Accordingly, it is an object of this invention to provide a new and improved shower apparatus for invalids and non-ambulatory persons which is characterized by a rotatable seat support mounted to a supporting column at one end and having an upward-standing seat pedestal and seat at the opposite end, for rotatably transferring an invalid or non-ambulatory person into a shower enclosure, allowing the person to shower while in the enclosure and subsequently transferring the occupant from the shower enclosure.

Another object of the invention is to provide a new and improved shower apparatus for non-ambulatory persons, which apparatus is characterized by a telescoping column designed to receive and rotatably mount a support provided with an upward-standing seat pedestal and seat for transferring a patient from a wheelchair or other support apparatus into a shower enclosure and from the shower enclosure back to the wheelchair.

Yet another object of the invention is to provide a new and improved shower apparatus which can be used with a conventional shower enclosure, which apparatus includes a support having one end rotatably mounted to a telescoping column located outside of the shower enclosure and the opposite end fitted with an upward-standing seat pedestal provided with a rotating seat, which support and seat can be selectively rotated into and out of the shower enclosure, in order to transfer a wheelchair-bound person from the wheelchair into the shower enclosure for showering, and from the shower enclosure back to the wheelchair.

SUMMARY OF THE INVENTION

These and other objects of the invention are provided in a new and improved shower apparatus for invalids and wheelchair-bound persons, which shower apparatus is characterized by a rotatable support or arm having one end secured in rotating fashion to an outside column and the opposite end provided with an upward-standing seat pedestal and a rotatable seat, which support is capable of rotating the seat to a wheelchair or a designated area located outside the shower enclosure for receiving a non-ambulatory person, rotatably transferring the person inside the shower enclosure for showering, and then back to the wheelchair. In a preferred embodiment, a latching mechanism is provided outside of the shower enclosure for latching a wheelchair securely with respect to the shower enclosure, in order to facilitate transfer of the patient from the wheelchair to the seat and from the seat back to the wheelchair, after showering.

BRIEF DESCRIPTION OF THE DRAWING

The invention will be better understood by reference to the accompanying drawings, wherein.

DESCRIPTION OF THE PREFERRED EMBODIMENTS

Figure 1:
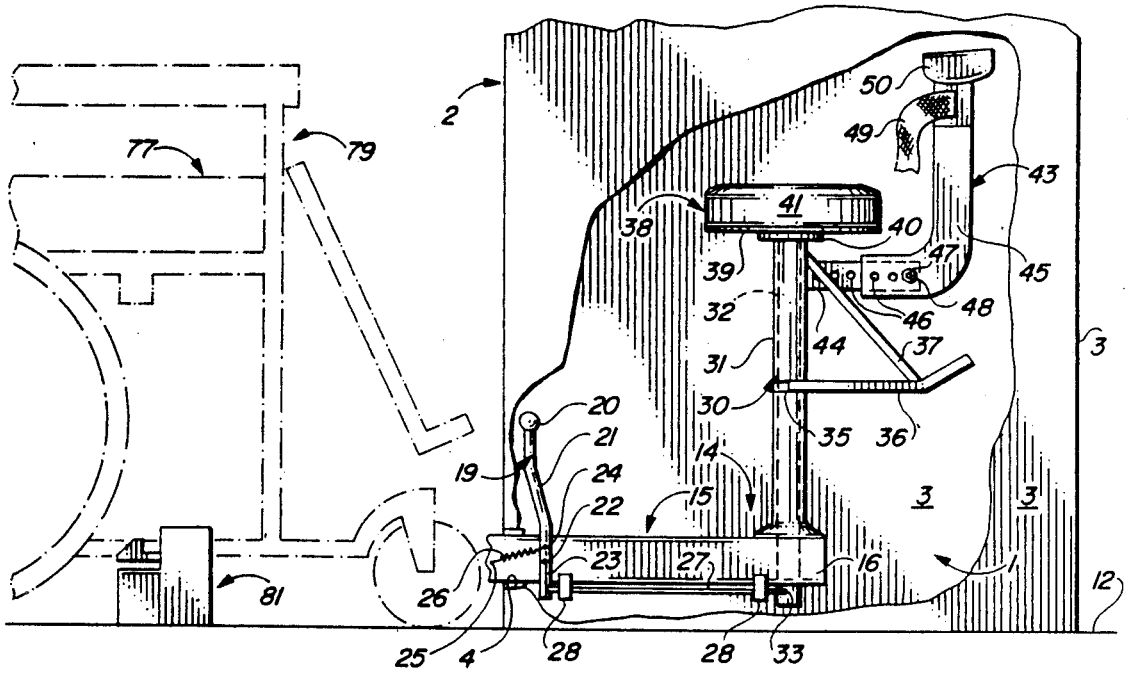
FIG. 1 is a side view, partially in section, of a preferred embodiment of the shower apparatus of this invention, with the rotatable support and seat apparatus located inside the shower enclosure.
Figure 2:
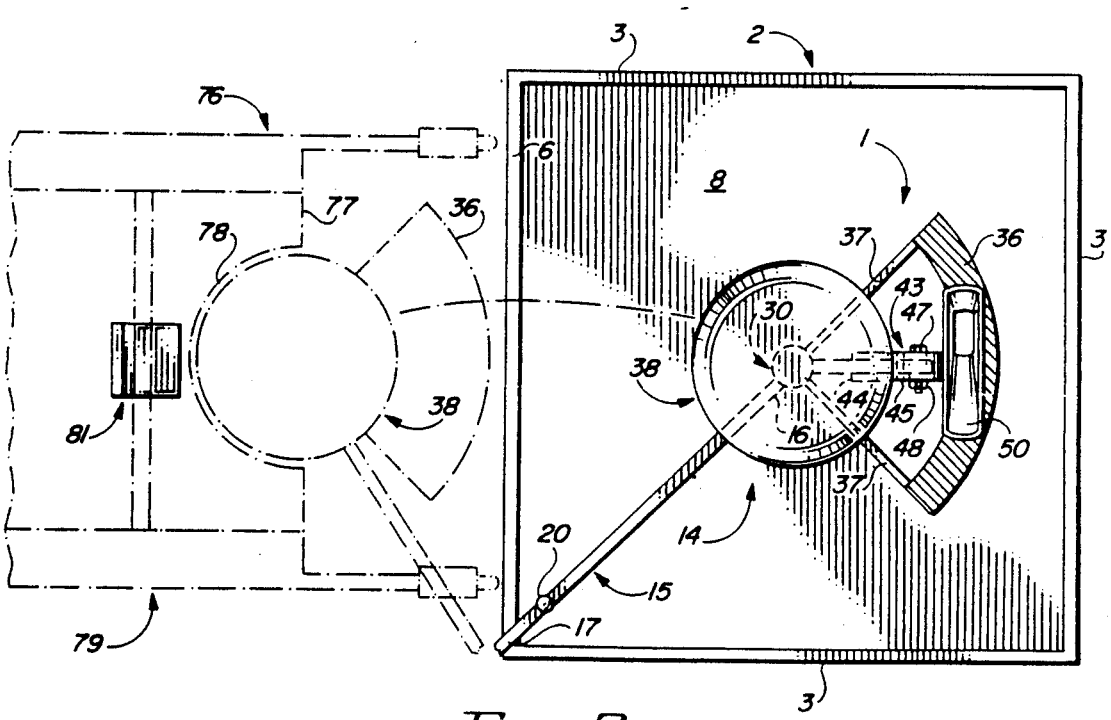
FIG. 2 is a top view of the shower apparatus illustrated in FIG. 1.
Figure 3:
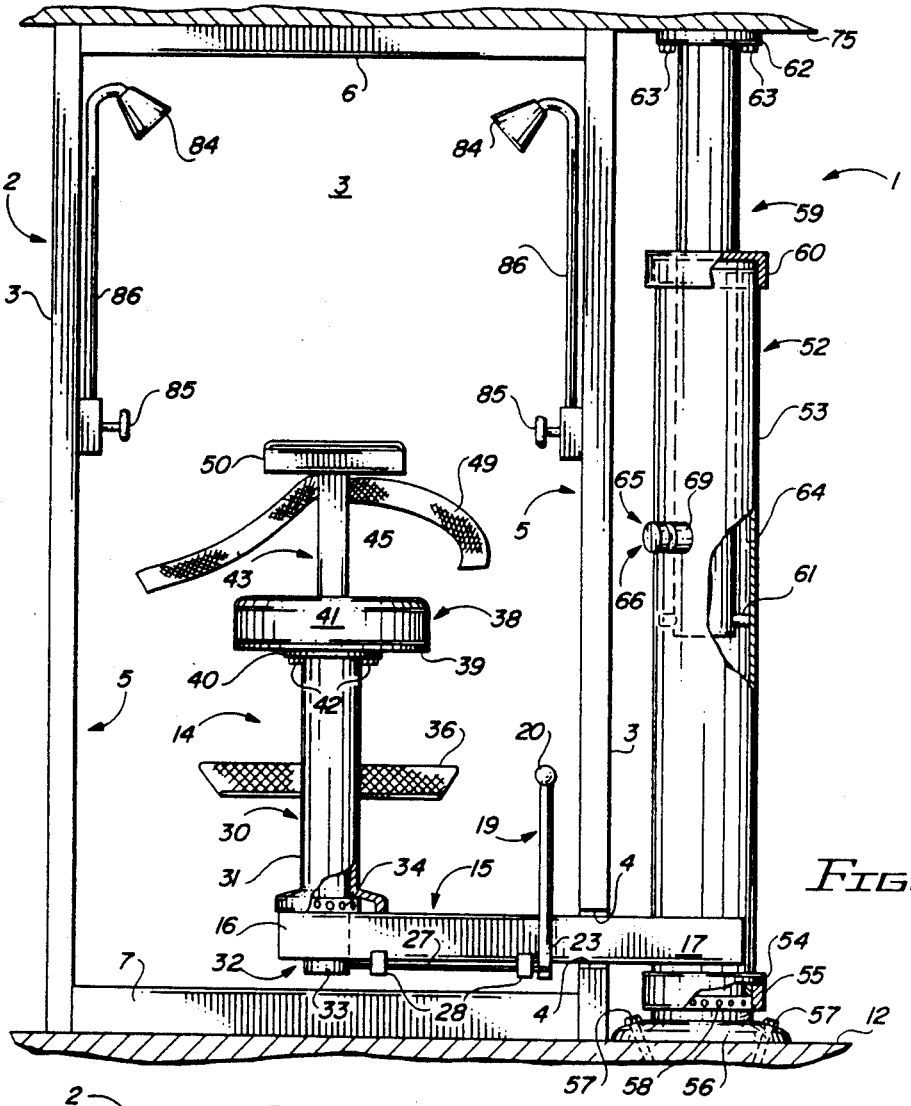
FIG. 3 is a front view of the shower apparatus illustrated in FIGS. 1 and 2, more particularly illustrating a preferred arm support column positioned outside of the shower enclosure.

Referring initially to FIGS. 1–3 of the drawings, in a most preferred embodiment the shower apparatus of this invention is generally illustrated by reference numeral 1 and is designed for us in cooperation with a conventional shower enclosure 2. The shower enclosure 2 is further characterized by enclosure walls 3 and an arm access opening 4, located near the splash shield 7, illustrated in FIG. 3, for receiving a rotatable support, generally illustrated by reference numeral 14, as hereinafter further described. A door frame 5 allows access to the interior of the enclosure 2 and a door brace 6 provides an upper framing member for the door frame 5. A conventional slanted enclosure floor 8 is provided with a drain 9 in the center thereof, as further illustrated in FIG. 4. The shower enclosure 2 is mounted on a floor structure 12, such as a conventional bathroom floor, by techniques well known to those skilled in the art.

Figure 4:
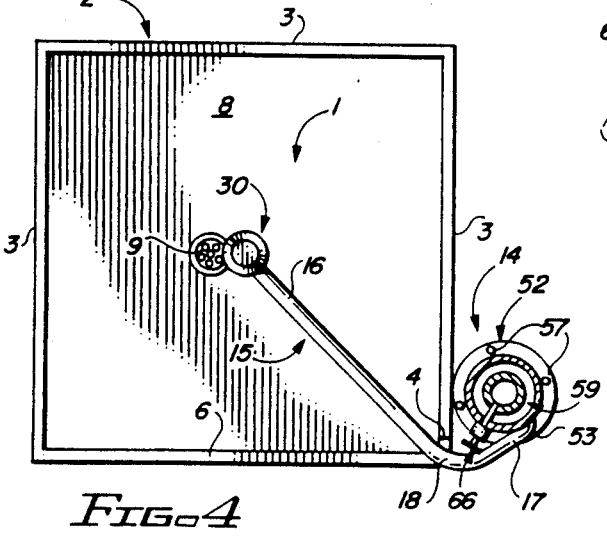
FIG. 4 is a top view of the shower apparatus, including the arm support column, with the rotatable support rotated into the shower enclosure and the seat removed for clarity.

Referring now to FIGS. 1–4 of the drawings, the rotatable support 14 is further characterized by a rotating arm 15, provided with an arm bend 18 near the mount end 17 thereof, as illustrated in FIG. 4, which mount end 17 is further secured to the base column 53 of an arm support 52 located outside of the shower enclosure 2, as further illustrated in FIGS. 3 and 4. The base column 53 is further provided with a base column collar 54, located at the bottom end of the base column 53, which base column collar 54 contains a base column bearing 58 and is seated on a base nipple 55, mounted on a base 56, as further illustrated in FIG. 3. The base 56 is secured to the floor structure 12 by means of multiple base mount bolts 57, as illustrated in FIG. 3. A telescoping column 59 fits concentrically inside the bore of the base column 53 and extends upwardly from a telescoping column collar 60, mounted on the top end of the base column 53, as further illustrated in FIG. 3. The extending end of the telescoping column 59 is fitted with a top mount plate 62, which is secured to the ceiling 75 by means of mount plate bolts 63. A spacer 61 is provided in the base column bore 64 of the base column 53 in order to align the telescoping column 59 concentrically and vertically inside the base column bore 64. Accordingly, it will be appreciated from a consideration of FIG. 3, that the base column 53 is rotatable with respect to the base 56 and the telescoping column 59 to facilitate pivoting of the rotating arm 15 in and out of the shower enclosure 2. The rotating arm 15 extends into the arm access opening 4, located in the enclosure wall 3 which is closest to the arm support 52, when the seat 38 is located inside the shower enclosure 2 and the arm access opening 4 facilitates rotation of the rotating arm 15 through a desired range of motion, as further illustrated in FIG. 4. The pedestal end 16 of the rotating arm 15 is adapted to receive an upward-standing seat pedestal 30, which includes a pedestal sleeve 31, that is welded or otherwise fixedly secured to the pedestal end 16 of the rotating arm 15. A seat bar 32 projects in rotatable fashion inside the hollow pedestal sleeve 31 and extends from the pedestal end 16 of the rotating arm 15 to receive the seat 38. A frame collar 40 is welded to the seat bar 32 and is secured to the seat frame 39 by means of the seat bolts 42. The seat frame 39 supports the seat cushion 41. The seat bar 32 is further fitted with a seat pedestal bearing 34 at the pedestal end 16 of the rotating arm 15, in order to facilitate free rotation of the seat bar 32 and the seat 38 with respect to the pedestal sleeve 31. A foot support 36 is also secured to the seat bar 32 and i rotatable with respect to the pedestal sleeve 31 by means of a foot support slot 35, provided in the pedestal sleeve 31, which foot support slot 35 is more particularly illustrated in FIG. 1. Foot support braces 37, illustrated in FIGS. 1 and 2, serve to strengthen the foot support 36. One end of a seat rotation lever 19 is pivotally attached to the rotating arm 15 by means of a pivot pin 22 and is fitted with a lever grip 20 at the extending end thereof, as well as an offset 21, located intermediate the lever grip 20 and the linkage end 23, as further illustrated in FIG. 1. A pedestal-engaging rod 27 is slidably mounted in a pair of spaced rod guides 28 to the rotating arm 15 as further illustrated in FIG. 1 and one end of the pedestal-engaging rod 27 i attached in pivotal relationship to the linkage end 23 of the seat rotation lever 19, while the opposite end selectively engages an opening (not illustrated) provided in the seat bar end 33 of the seat bar 32. In another preferred embodiment of the invention a lever spring 26 is oriented with one end 24 secured to the linkage end 23 of the seat rotation lever 19 and the opposite end of the lever spring 26 fixedly mounted to the rotating arm 15 by means of an arm frame pin 25. Accordingly the seat bar 32 and seat 38 are normally oriented in locked configuration, with the projecting end of the pedestal engaging rod 27 engaging an opening (not illustrated) in the seat bar end 33 to prevent the seat 38 and the seat bar 32 from rotating. However, when it is desired to rotate the seat 38 and the seat bar 32, pressure is exerted against the seat rotation lever 19 and the bias of the lever spring 26 to remove the projecting end of the pedestal engaging rod 27 from the opening in the seat bar end 33.

Referring again to FIGS. 1–4 of the drawing, in another preferred embodiment of the invention a soap dish bracket 43 is adjustably mounted to the seat pedestal 30 by means of a pedestal bracket arm 44 and a cooperating soap dish bracket arm 45. In a most preferred embodiment of the invention, the soap dish bracket arm 45 and the pedestal bracket arm 44 are telescopically linked, such that a bracket bolt 47 ca be inserted through registering adjusting holes 46, as illustrated in FIGS. 1 and 2, to extend the soap dish bracket arm 45 from the seat pedestal 30 to a desired spacing. A nut 48 is threadibly attached to the bracket bolt 47, in order to secure the soap dish bracket arm 45 to the pedestal bracket arm 44. A seat belt 49 is also attached to the upper end of the soap dish bracket arm 45 and a soap dish 50 is provided on the soap dish bracket arm 45, as illustrated.

Figure 5:
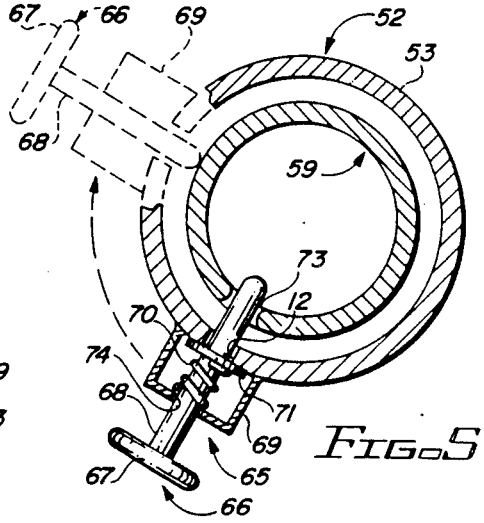
FIG. 5 is a sectional view of the arm support column illustrated in FIGS. 3 and 4, more particularly illustrating a preferred latching apparatus for selectively immobilizing the pivoting element in the arm support column.

Referring now to FIGS. 3, 4 and 5 of the drawings, in yet another preferred embodiment of the invention the locking apparatus 65 is fitted to the base column 53 of the arm support 52, to facilitate controlled rotation of the base column 53 and the rotating arm 15 with respect to the enclosure 2. As illustrated in FIG. 5, the locking apparatus 65 is further characterized by a lock pin 66, having a pin grip 67 on the extending end thereof. A pin shaft 68 projects from the pin grip 67 inwardly through an outer pin opening 72, provided in the base column 53 and a registering inner pin opening 73, provided in the telescoping column 59. A shaft housing 69 is welded or otherwise fixedly attached to the base column 53, in order to receive the pin shaft 68, which extends through a housing opening 74 to facilitate gripping of the pin grip 67. A shaft spring 70 is seated inside the shaft housing 69 and a spring washer 71 mounts one end of the spring 70, while the opposite end of the spring 70 seats against the top of the shaft housing 69. Accordingly, it will be appreciated that pressure ca be exerted outwardly of the base column 53 by gripping the pin grip 67, to compress the shaft spring 70 and facilitate retraction of the extending end of the pin shaft 68 from the inner pin opening 73, to a position against the telescoping column 59, as illustrated in phantom. This manipulation of the locking apparatus 5 facilitates rotation of the base column 53 and the rotating arm 15 to selectively position the seat 38 inside or outside of the shower enclosure 2, as hereinafter described.

Referring again to FIGS. 1 and 2 of the drawings, in a most preferred embodiment of the invention a latching device 81 is illustrated, for removably securing a wheelchair 76 in close proximity to the shower enclosure 2 in order to transfer an occupant from the wheelchair 79 to the seat 38 and into the shower enclosure 2. The latching device 81 may be of the same design as the latching device detailed in my U.S. Pat. No. 4,729,573, dated Mar. 8, 1988, entitled "Wheelchair Latching Device". The shower apparatus 1 can then be operated by manipulating the lock pin 66 with locking apparatus 65 from the position illustrated in phantom to the locked position illustrated in FIG. 5, as the base column 53 and the rotating arm 15 are rotated to locate the seat 38 in the support contour 78 of the wheelchair support 77. This operation immobilizes the seat 38 in the support contour 78 and allows a wheelchair-bound person to move from the wheelchair support 77 to the seat 38. The lock pin 66 is then again manipulated to facilitate rotation of the seat 38 into the shower enclosure 2, as illustrated in FIGS. 1 and 2. The shower enclosure 2 can then be utilized in conventional fashion, with the occupant adjusting one or more of the shower nozzles 84 and manipulating one or more of the nozzle handles 85 which channels water through the shower piping 86 to the occupant while the occupant is seated on the seat 38. The occupant can then be relocated back to the wheelchair 76, as illustrated in FIG. 2, in position for transfer back into the wheelchair 76. The latching device 81 can then be released and the wheelchair 76 maneuvered from the bathing area. It will be appreciated by those skilled in the art that the wheelchair 76 may be conventional in design, and fitted with a wheelchair support 77, having a rounded support contour 78, for accommodating the seat 38, as illustrated in phantom in FIG. 2. Furthermore, the wheelchair frame 79 can also be conventional in design, but may be fitted with a latch-receiving device (not illustrated), in order to removably attach to the latching device 81.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A shower apparatus and a wheelchair in combination, said shower apparatus mounted adjacent to a shower enclosure in a bathing area having a floor and a ceiling, said shower enclosure further comprising an arm support characterized by a substantially vertically-oriented base column adapted to be rotatably mounted to the floor of the bathing area and a fixed column carried by said base column, with a top end of said fixed column adapted to be fixedly secured to the ceiling of the bathing area; arm means carried by said base column; and seat means upward-standing from said arm means for supporting an occupant and said wheelchair provided with a support having a support contour for receiving said seat means, said wheelchair located in close proximity to said shower enclosure, whereby said seat means and the occupant are selectively maneuvered from the wheelchair into and out of the shower enclosure responsive to rotation of said base column and said arm means with respect to said fixed column.

2. The shower apparatus of claim 11 further comprising base column lock means carried by said base column and adapted to selectively engage said fixed column and prevent rotation of said base column with respect to said fixed column.

3. The shower apparatus of claim 2 wherein:

(a) said arm means further comprises an elongated arm having an arm bend near one end thereof, wherein said one end of said arm is fixedly attached to said base column and the opposite end of said arm receives said pedestal sleeve and said seat bar; and (b) said seat means further comprises a hollow pedestal sleeve upward-standing from said arm means in fixed relationship; a seat bar projecting through said pedestal sleeve and mounted on said arm in vertical, rotatable relationship; and a seat fixedly attached to the upper end of said seat bar, whereby said seat is rotatably mounted with respect to said pedestal sleeve and said arm.

4. The shower apparatus of claim 3 further comprising seat lock means carried by said arm and adapted to selectively engage said seat bar to prevent rotation of said seat bar and said seat with respect to said arm.

5. A shower apparatus for use with a shower enclosure in a bathing area having a floor and a ceiling, comprising an arm support characterized by a substantially vertically-oriented base column adapted to be rotatably mounted to the floor of the bathing area and a fixed column carried by said base column in telescoping relationship, with a extending end of said fixed column adapted to be fixedly secured to the ceiling of the bathing area; an elongated arm having one end carried by said base column; a hollow pedestal sleeve upward-standing from the opposite end of said arm in fixed relationship; a seat bar projecting through said pedestal sleeve and mounted on said opposite end of said arm in vertical, rotatable relationship; a seat fixedly attached to the upper end of said seat bar; seat lock means carried by said arm and adapted to selectively engage said seat bar to prevent rotation of said seat bar and said seat with respect to said arm; and bracket means carried by said pedestal sleeve and adapted to project above said seat and adapted to support a soap dish, whereby said seat is rotatably mounted with respect to said pedestal sleeve and said arm for supporting an occupant and selectively maneuvering said seat and the occupant into and out of the shower enclosure responsive to rotation of said base column and said arm with respect to said fixed column.

* * * * *